US011825997B2

(12) United States Patent
Smith

(10) Patent No.: US 11,825,997 B2
(45) Date of Patent: Nov. 28, 2023

(54) VACUUM EXTRACTION HEAD WITH ADJUSTABLE-HEIGHT BRUSH

(71) Applicant: Harris Research, Inc., Nashville, TN (US)

(72) Inventor: Christopher Wayne Smith, Logan, UT (US)

( * ) Notice: Subject to any disclaimer, the term of this patent is extended or adjusted under 35 U.S.C. 154(b) by 0 days.

(21) Appl. No.: 17/531,357

(22) Filed: Nov. 19, 2021

(65) Prior Publication Data

US 2023/0157509 A1 May 25, 2023

(51) Int. Cl.
*A47L 11/40* (2006.01)
*A47L 11/34* (2006.01)
(Continued)

(52) U.S. Cl.
CPC ..... *A47L 11/4058* (2013.01); *A47L 7/0004* (2013.01); *A47L 9/066* (2013.01); *A47L 11/34* (2013.01); *A47L 11/4036* (2013.01)

(58) Field of Classification Search
CPC ..... A47L 11/4058; A47L 11/4052; A47L 11/4036; A47L 11/24; A47L 11/202;
(Continued)

(56) References Cited

U.S. PATENT DOCUMENTS 1,506,016 A * 8/1924 Lundgren ..... A47L 11/4038 15/52
1,517,980 A * 12/1924 Green ..... A47L 11/4077 15/52
(Continued)

FOREIGN PATENT DOCUMENTS

EP 1145679 A1 * 10/2001 ..... A47L 11/162
FR 2547191 A 12/1984
(Continued)

OTHER PUBLICATIONS

Translation of JP H08336491 A (Year: 1995).*
(Continued)

*Primary Examiner* — Brian D Keller
*Assistant Examiner* — Steven Huang
(74) *Attorney, Agent, or Firm* — Husch Blackwell LLP; Timothy L. Capria; Alexandra C. Lynn

(57) ABSTRACT

An extraction head for a cleaning machine is disclosed for traveling along a cleaning path on a variable-height floor. The extraction head comprises a body including a floor-facing surface and an extraction aperture disposed in the floor-facing surface. The extraction head comprises a vacuum outlet in fluid communication with the extraction aperture. The extraction head comprises an adjustable-height brush positioned in front of the extraction head body along the cleaning path. The adjustable-height brush is configured to translocate upwardly and downwardly as the extraction head moves along the cleaning path on the variable-height floor. The adjustable-height brush may comprise a proximal end and a distal end opposite the proximal end. The proximal and distal ends may be configured to translocate upwardly and downwardly relative to each other as the extraction head moves along the cleaning path on the variable-height floor.

11 Claims, 11 Drawing Sheets

(51) Int. Cl.
*A47L 9/06* (2006.01)
*A47L 7/00* (2006.01)

(58) Field of Classification Search
CPC ..... A47L 11/20; A47L 11/28; A47L 11/29; A47L 11/30; A47L 11/302; A47L 11/305; A47L 11/307; A47L 11/292; A47L 11/293; A47L 11/34; A47L 11/201; A47L 11/206; A47L 11/40; A47L 11/4044; A47L 11/282; A47L 11/283; A47L 9/0666; A47L 9/066; A47L 9/0633; A47L 9/06; A47L 9/0626; A47L 9/062; A47L 9/068; A47L 9/0646; A47L 9/0653; A47L 9/0494; A47L 9/0488; A47L 5/34; A47L 7/0004; A46B 7/026; A46B 7/023
See application file for complete search history.

(56) References Cited

U.S. PATENT DOCUMENTS

| | | | | | |
|---|---|---|---|---|---|
| 1,736,446 | A * | 11/1929 | Keefer | A47L 11/4083 | 15/368 |
| 2,978,719 | A | 4/1961 | Arones | | |
| 2,997,729 | A * | 8/1961 | Kasper | A47L 9/06 | 15/373 |
| 2,999,258 | A | 9/1961 | Berberian | | |
| 3,040,367 | A | 6/1962 | Hellstrom | | |
| 3,045,267 | A * | 7/1962 | Wagner | A47L 11/40 | 15/79.2 |
| 3,599,271 | A | 8/1971 | Ljung et al. | | |
| 3,644,960 | A * | 2/1972 | Danzig | A47L 11/305 | 15/372 |
| 3,821,831 | A | 7/1974 | Grover | | |
| 4,976,003 | A | 12/1990 | Williams | | |
| 5,555,599 | A * | 9/1996 | Markley | A47L 9/06 | 15/322 |
| 6,029,311 | A * | 2/2000 | Scanni | A47L 9/2884 | 15/373 |
| 6,385,811 | B1 * | 5/2002 | Dilger | A47L 9/0653 | 15/373 |
| 6,643,894 | B1 * | 11/2003 | Dell | A47L 9/02 | 15/385 |
| 2011/0219565 | A1 | 9/2011 | Sepke | | |
| 2012/0023698 | A1 * | 2/2012 | Durrant | A47L 11/34 | 15/319 |
| 2012/0233804 | A1 | 9/2012 | Studebaker | | |

FOREIGN PATENT DOCUMENTS

| | | | | |
|---|---|---|---|---|
| GB | 595964 | A | 12/1947 | |
| GB | 2305112 | A * | 4/1997 | A47L 11/164 |
| JP | H08336491 | A * | 6/1995 | |

OTHER PUBLICATIONS

Translation of EP 1145679 A1 (Year: 2001).*
Australian Patent Office, International Search Report and Written Opinion for International Application No. PCT/US2022/050551, dated Jan. 20, 2023.

* cited by examiner

VACUUM EXTRACTION HEAD WITH ADJUSTABLE-HEIGHT BRUSH

TECHNICAL FIELD

The present disclosure relates to carpeted floor cleaning devices. Particularly, the present disclosure relates to cleaning devices having vacuum extraction heads with adjustable-height brushes.

BACKGROUND

The cleaning of carpeted floors to remove stains, dirt, etc., is achieved using various methods, including dry-cleaning techniques, wet-cleaning techniques, and vacuuming. Wet-cleaning, or steam cleaning as it is commonly known, is a technique that involves spraying cleaning solution onto the floor, agitation of the floor, and extraction of the cleaning solution. The agitation step may be completed by a brush or other scrubbing device that is passed over the floor. Several passes of the scrubbing device over the floor may be used to loosen stains or dirt (collectively, debris) from the surface.

Many carpeted floors are variable height and contain bumps, ridges, differing piles, wear, and other irregular features. Variable-height floors prevent cleaning devices from uniformly cleaning floors because the cleaning device cannot maintain consistent contact with the floor around irregular features. Further, variable-height floors may reduce the cleaning effectiveness of the brush as the bristle stems on the brush, rather than the bristle tips, are used to agitate the floor. Variable-height floors can cause premature wear to the brush and other parts of the cleaning device. The issue of premature wear is particularly an issue for motorized cleaning devices that may move the brush repeatedly over an irregular feature.

BRIEF SUMMARY

In view of the above, there is an unmet need in the art for an extraction head for a cleaning device for traveling along a cleaning path on a variable-height floor.

The present disclosure affords such an extraction head. In a first aspect, the extraction head comprises an extraction head body including a floor-facing surface and an extraction aperture disposed in the floor-facing surface. The extraction head also comprises a vacuum outlet in fluid communication with the extraction aperture. Additionally, the extraction head comprises an adjustable-height brush positioned in front of the extraction head body along the cleaning path. The adjustable-height brush is configured to translocate upwardly and downwardly as the extraction head moves along the cleaning path on the variable-height floor. The adjustable-height brush may also comprise a proximal end and a distal end opposite the proximal end. The proximal and distal ends may be configured to translocate upwardly and downwardly relative to each other as the extraction head moves along the cleaning path on the variable-height floor.

In a second aspect, a cleaning device for cleaning a variable-height floor is provided. The cleaning device comprises a rotary vacuum head comprising a plurality of vacuum chambers disposed radially on the rotary vacuum head with each vacuum chamber including an inlet. The cleaning device also comprises a plurality of extraction heads adjustably secured to the rotary vacuum head for traveling along a cleaning path on a variable-height floor. The plurality of extraction heads are adjustably secured to the rotary vacuum head.

Each extraction head comprises an extraction head body including a floor-facing surface and an extraction aperture disposed in the floor-facing surface. Additionally, each extraction head also comprises a vacuum outlet in fluid communication with the extraction aperture. Each inlet is in fluid communication with the at least one vacuum outlet. Each extraction head also comprises an adjustable-height brush positioned in front of the extraction head body along the cleaning path. The adjustable-height brush is configured to translocate upwardly and downwardly as the extraction head moves along the cleaning path on the variable-height floor. The adjustable-height brush may also comprise a proximal end and a distal end opposite the proximal end. The proximal and distal ends may be configured to translocate upwardly and downwardly relative to each other as the extraction head moves along the cleaning path on the variable-height floor.

These features and advantages of the present disclosure will become more fully apparent from the following description and appended claims or may be learned by the practice of the disclosure as set forth hereinafter.

BRIEF DESCRIPTION OF THE DRAWINGS

The objects, features, and advantages of the present disclosure will become better understood regarding the following description and accompanying drawings, wherein.

DETAILED DESCRIPTION

Reference throughout this specification to "one embodiment," "an embodiment," or similar language means that a particular feature, structure, or characteristic described in connection with the embodiment is included in at least one embodiment of the present disclosure. Thus, appearances of the phrases "in one embodiment," "in an embodiment," and similar language throughout this specification may, but do not necessarily, all refer to the same embodiment.

Furthermore, the described features, structures, or characteristics of the disclosure may be combined in any suitable manner in one or more embodiments. In the following description, numerous specific details are provided to give a thorough understanding of embodiments of the disclosure. One skilled in the relevant art will recognize, however, that the disclosure may be practiced without one or more of the specific details, or with other methods, components, materials, and so forth. In other instances, well-known structures, materials, or operations are not shown or described in detail to avoid obscuring aspects of the disclosure.

Figure 1:
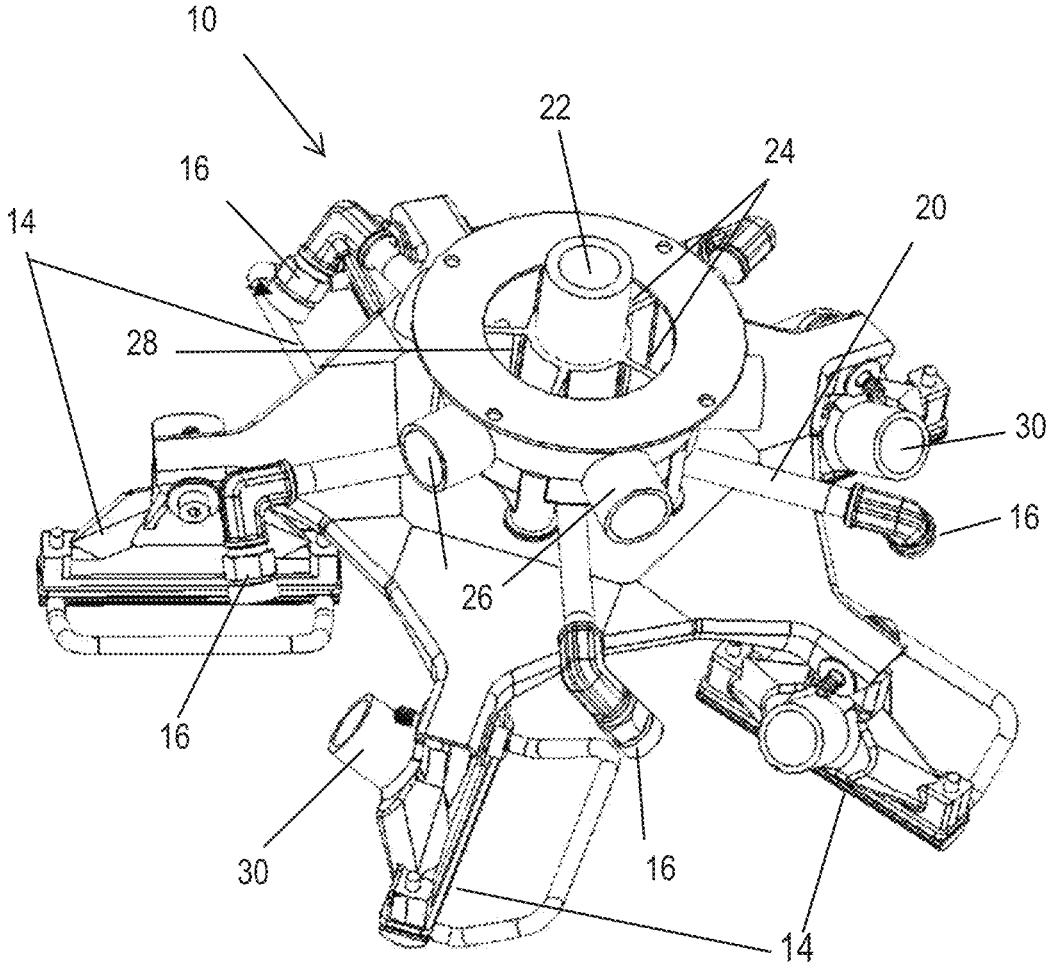
FIG. 1 is a top perspective view illustrating one embodiment of a rotary head cleaning machine with attached extraction heads.

FIG. 1 is a perspective view illustrating one embodiment of a vacuum rotary head 10 of a floor cleaning device, such as for cleaning soft (e.g., carpeted) floor surfaces. The vacuum rotary head 10 is coupled with one or more extraction heads 14 (shown in more detail in FIGS. 2-8) having an adjustable-height, as described further, below. By way of example, FIG. 1 depicts a vacuum rotary head 10 with five extraction heads 14. However, the vacuum rotary head 10 may include more or fewer extraction heads 14 (e.g., from one to twenty or any subvalue or range thereof), depending on the floor cleaning device and/or the type of flooring to be cleaned.

In some embodiments, the vacuum rotary head 10 includes at least one spray nozzle 16 fluidly coupled to a cleaning solution supply for dispersing one or more cleaning solutions on the floor surface. The vacuum rotary head 10 may be configured with any suitable number of the spray nozzles 16, each fluidly coupled with the cleaning solution supply. The vacuum rotary head 10 may have an equal number of spray nozzles 16 and extraction heads 14, wherein each of the extraction heads 14 is disposed proximate to one of the spray nozzles 16, as depicted in the embodiment of FIG. 1. The cleaning solution may be water or water and one or more cleaning agents (e.g., detergents, soaps, emulsifiers, whiteners, bleachers, surfactants, solvents, carbonators, etc.). The solution may be pressurized within the device. The cleaning solution may be supplied from the cleaning solution supply to the spray nozzles 16 via one or more supply lines 20 fluidly connecting the solution supply with the spray nozzles 16. The supply lines 20 may be disposed (partially or fully) within, or defined by a hollow (including partially hollow) driveshaft 22, which connects the vacuum rotary head 10 with the cleaning device and drives (e.g., is configured to selectively cause rotation of) the vacuum rotary head 10.

The cleaning device may include a vacuum chamber 24 having a plurality of inlets 26. In some embodiments, the vacuum chamber 24 may comprise one or more sub-chambers 28. The sub-chambers 28 may be disposed radially on the rotary vacuum head 10. The sub-chambers 28 are each in fluid communication with the inlets. The vacuum chamber 24 (and/or its sub-chambers 28) may comprise more than one of the inlets on the chamber 24 and each of the sub-chambers 28. Each of the inlets are in fluid communication with a vacuum outlet 30 of each of the extraction heads 14.

The plurality of inlets may be disposed around and approximately equidistant from the hollow driveshaft 22. In some embodiments, such as the embodiment shown in FIG. 1, there are an equal number of extraction heads 14 and inlets. In other embodiments, there are a varying number of extraction heads 14 and inlets, such as more extraction heads 14 than inlets. Each of the inlets may be in fluid communication with more than one of the extraction heads 14.

The extraction head 14 removes liquid, including dispersed water and cleaning solution, and any other pretreatment, dirty water, or other debris and other liquids or solvents from the floor. The extraction head 14 comprises an extraction head body 32. The extraction head body 32 includes a floor-facing surface disposed on the head body 32 such that, when the cleaning device is in use, the floor-facing surface faces the floor being cleaned. One or more extraction apertures 36 may be disposed in the floor-facing surface and in fluid communication with the vacuum outlet 30. The vacuum outlet 30 may be disposed on an upper side of the extraction head body 32 and oriented rearwardly on the extraction head body 32, that is, opposite on the extraction head body 32 the direction of travel of the extraction head 14 moving along the cleaning path. The extraction head body 32 may also include a hollow interior. The hollow interior, whether through hoses or passageways defined by the hollow interior, may fluidly connect the vacuum outlet 30 to the one or more extraction apertures 36 such that the hollow interior and the vacuum outlet 30 are in fluid communication via the hollow interior.

The extraction head 14 may include a base plate 42. The one or more extraction apertures 36 may be disposed in the base plate 42. The base plate 42 may be secured with the floor-facing surface of the extraction head body 32. The base plate 42 may be integrally formed with, or discrete from, the extraction head body 32. A gasket may be disposed between the base plate 42 and the extraction head body 32 to define a seal, such as a water-tight or a vacuum-tight seal. The base plate 42 may be elongated and constructed of any suitable material (e.g., a metal, an alloy, or a polymer). The base plate 42 may sit a distance (such as about 0.125 inch, about 0.25 inch, or about 0.5 inch) above the floor surface to permit the base plate 42 to pass over the floor surface without contacting the floor surface when the floor surface cleaned, improving vacuum efficiency of the extraction head 32. In other embodiments of the disclosure, the base plate 42 may be lower relative to, or contact, the floor surface, and the base plate 42 may be coated with an anti-friction coating to move across a floor surface more easily. Examples of coatings suitable for use in the present disclosure include, but are not limited to, polytetrafluoroethylene (PTFE). In further embodiments, various components of the extraction head 14 may be formed of PTFE, other low-friction polymers, metals, or composites.

Referring to FIGS. 2-7, the extraction head 14 may comprise a mount 44 for releasably securing the extraction head 14 with the vacuum rotary head 10. In some embodiments, the mount 44 comprises a mount aperture through which a fastener 48 (such as a bolt or any suitable fastening device) engages to secure the extraction head 14 to the vacuum rotary head 10.

The extraction head 14 may comprise an adjustable-height brush 50. The brush 50 may be positioned forward of the extraction head 14. In this context, "forward" means that the brush 50 is located ahead of the extraction head 14 relative to the direction of travel of the brush 50 and extraction head 14 on the cleaning path.

The brush 50 may be attached to the vacuum rotary head 10 via the extraction head 14, or the brush 50 may be secured directly to the vacuum rotary head 10. The brush 50 may comprise a plurality of bristles 52 and a ferrule 54 securing the plurality of bristles 52 with the brush 50. Each of the bristles 52 comprises a stem, a base, and a tip. Each of the bases of the plurality of bristles 52 is secured within the ferrule 54. The bristles 52 may be soft or firm. In some embodiments of the disclosure, the bristles 52 are firm and are advantageous because they extract more solution from carpeted flooring, as they pass over the floor, as compared to soft bristles 52.

The brush 50 is adjustable in height and is configured to translocate upwardly and downwardly relative to the extraction head body 32 as the extraction head 14 moves along the cleaning path on the variable-height floor. The brush 50 may move partially independent of the extraction head body 32 and base plate 42, that is, the brush 50 may move together with the head body 32 and base plate 42 to a degree and move independently of the head body 32 and the base plate 42 to a degree. The degree that the brush 50 can move upwardly and downwardly independently and relative to the base plate 42 may define a brush vertical range. At the bottom of the brush vertical range, the tips of the bristles 52 may extend lower than the base plate 42. At the top of the brush vertical range, the tips of the bristles 52 may be equal to or higher than the floor-facing surface of the base plate 42.

Figure 7:
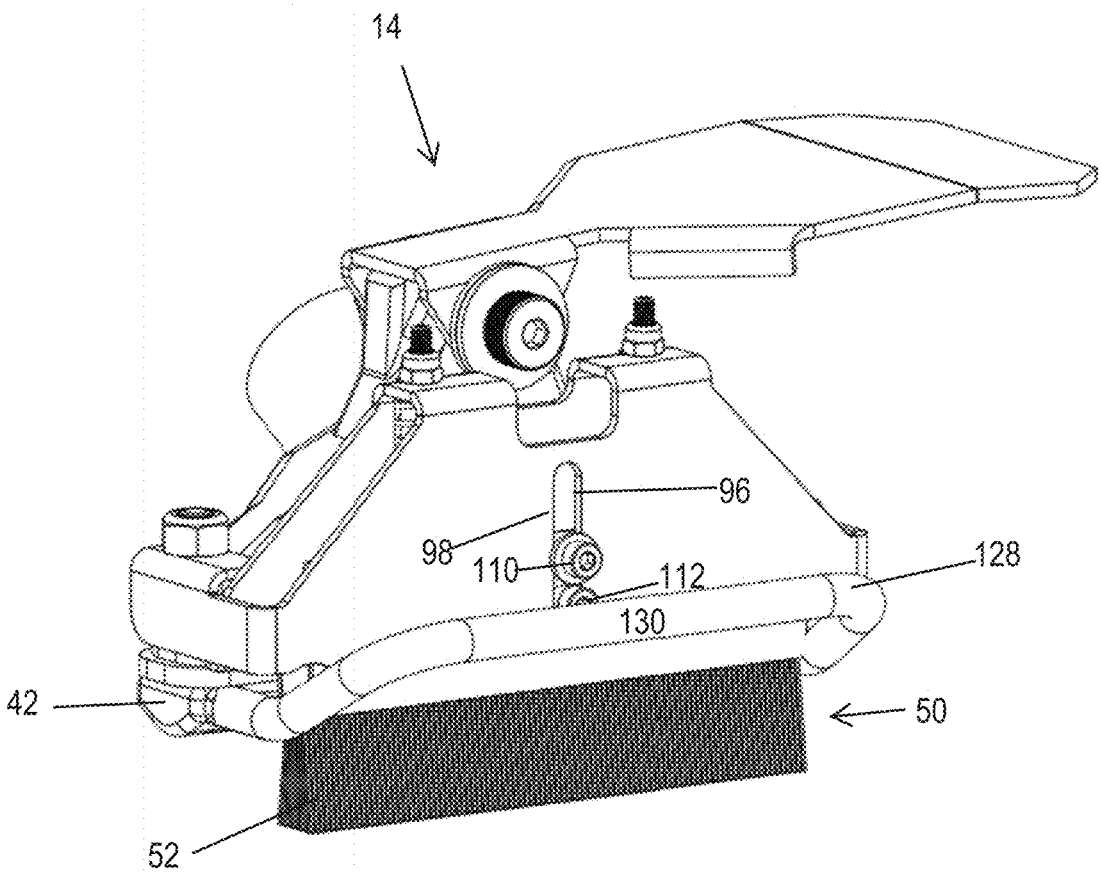
FIG. 7 is a perspective view illustrating one embodiment of an extraction head showing the brush at a first height.
Figure 8:
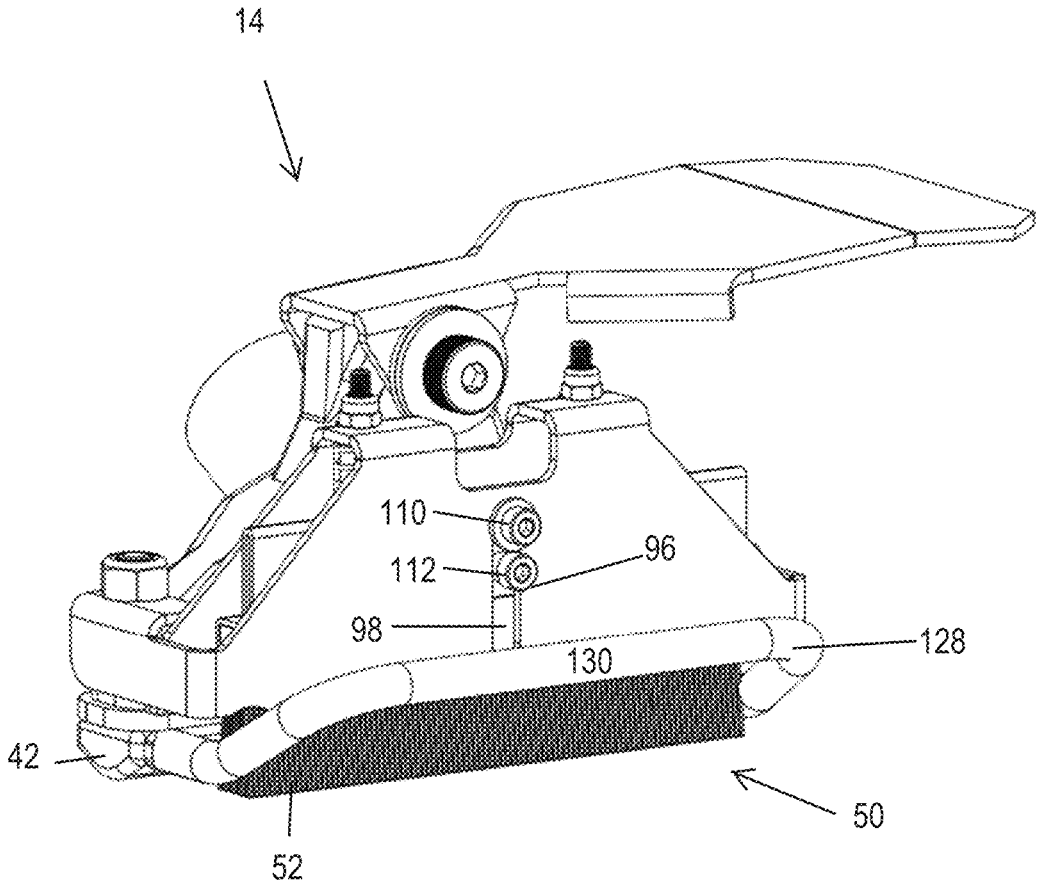
FIG. 8 is another perspective view illustrating one embodiment of an extraction head showing the brush at a second height.

Advantageously, the height-adjustable brush 50 can move up and down (i.e., upwardly and downwardly translocate) in response to variance in the height of the floor being cleaned. FIG. 7 depicts an embodiment of the extraction head with the brush at the lowest position permitted by the depicted embodiment. FIG. 8 depicts an embodiment of the extraction head with the brush at the highest position permitted by the depicted embodiment. The degree of the brush movement within the vertical range is directly related to the degree of height variation of the floor being cleaned. By way of example, if the extraction head 14 moves over a rise or obstruction in the floor that is less than the brush vertical range, the extraction head body 32 and base plate 42 may rise a short distance while the brush 50 stays on a generally level path. Some of the plurality bristles 52 of the brush 50 may deflect to allow the rise or obstruction to pass through the brush 50 while the remainder of the plurality of the bristles 52 remain generally orthogonal to the floor surface to agitate the floor surface around the rise or obstruction. The brush 50 may rise a distance due to the upward force exerted on the brush by the rise or obstruction rather than the extraction head body 32 exerting force on the brush 50. In another example, if the extraction head 14 moves over a rise or obstruction taller than the brush vertical range, the extraction head body 32 and base plate 42 may rise and lift the brush 50 off of the floor, although the brush 50 may rise less than the base plate 42 due to the brush vertical range. In a further example, if the extraction head 14 moves off of a rise or an obstruction in the floor surface, the brush 50 may lower and contact the surface at a base of the rise or obstruction before the base plate 42 lowers onto the surface at the base of the rise or obstruction.

Figure 9A:
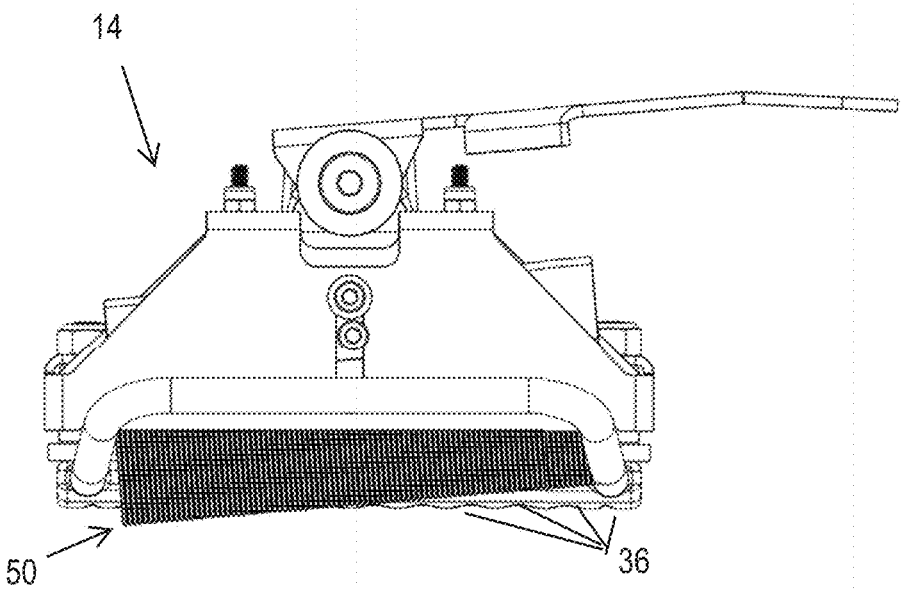
FIG. 9A-9B are front elevation views illustrating one embodiment of an extraction head with a brush in various orientations.
Figure 9B:
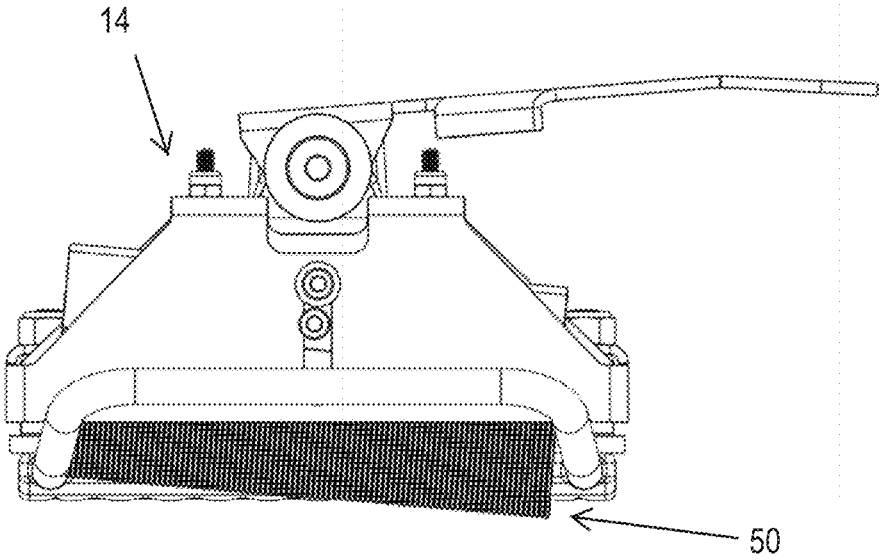

The brush 50 may also comprise a proximal end 62 that is closer to the center of the rotary vacuum head 10 and a distal end 64 that is opposite the proximal end 62 and farther from the center of the rotary vacuum head 10. In some embodiments, the height-adjustable connection between the extraction head body 32 and the brush 50 may allow the brush proximal and distal ends 62, 64 to translocate upwardly and downwardly relative to each other and the extraction head body 32. In other words, the brush 50 may tilt or rotate in a vertical plane that is perpendicular to the cleaning path of the extraction head 14. FIGS. 9A-9B depict an embodiment of the extraction head with the brush rotated in opposite directions, that is, with one spring 80 in a more compressed position than the other spring 80 such that the proximal and distal ends 62, 64 are at uneven heights, and the brush is shown as tilting within the vertical plane. The movements of the brush proximal and distal ends 62, 64 are also at least partially independent from each other and from the extraction head body 32. That is, the brush proximal and distal ends 62, 64 may move together with each other and the extraction head body 32 to a degree, and the proximal and distal brush ends 62, 64 may move independently of each other or of the extraction head body 32 to a degree. The rotational or tilting movement may allow one of the brush proximal end 62 or distal end 64 to be lower than the floor-facing surface of the base plate 42 while the higher of the brush proximal end 62 or distal end 64 is equal to or higher than the floor-facing surface of the base plate 42. The net difference of the height difference a fully rotated or tilted proximal end 62 and distal end 64, in absolute numbers, is referred to as the brush tilt range. The brush tilt range may be 0.01 inch to 5 inches, or any subrange or subvalue thereof.

The degree of independence of the movements of the brush ends 62, 64 are from each other depends on the level of the brush tilt range and the variance of the height of the floor. For example, the brush 50 may pass over a variable-height floor where the surface under the proximal end 62 is higher than the surface under the distal end 64. If the height difference between the surfaces under each brush end 62, 64 is less than the brush tilt range, the brush 50 may tilt such that the brush proximal end 62 is higher than the brush distal end 64 without lifting the brush distal end 64 off the floor. Thus, the brush 50 may contact both the higher and lower areas of the variable-height floor if the height difference between the surfaces under each brush end 62, 64 is less than the brush tilt range. If the height difference between the surfaces under each brush end 62, 64 is greater than the brush tilt range, the brush 50 may still tilt such that the proximal end 62 is higher than the distal end 64. However, the brush distal end 64 may lift off the floor due to the upward force exerted on the proximal end 62.

Figure 10:
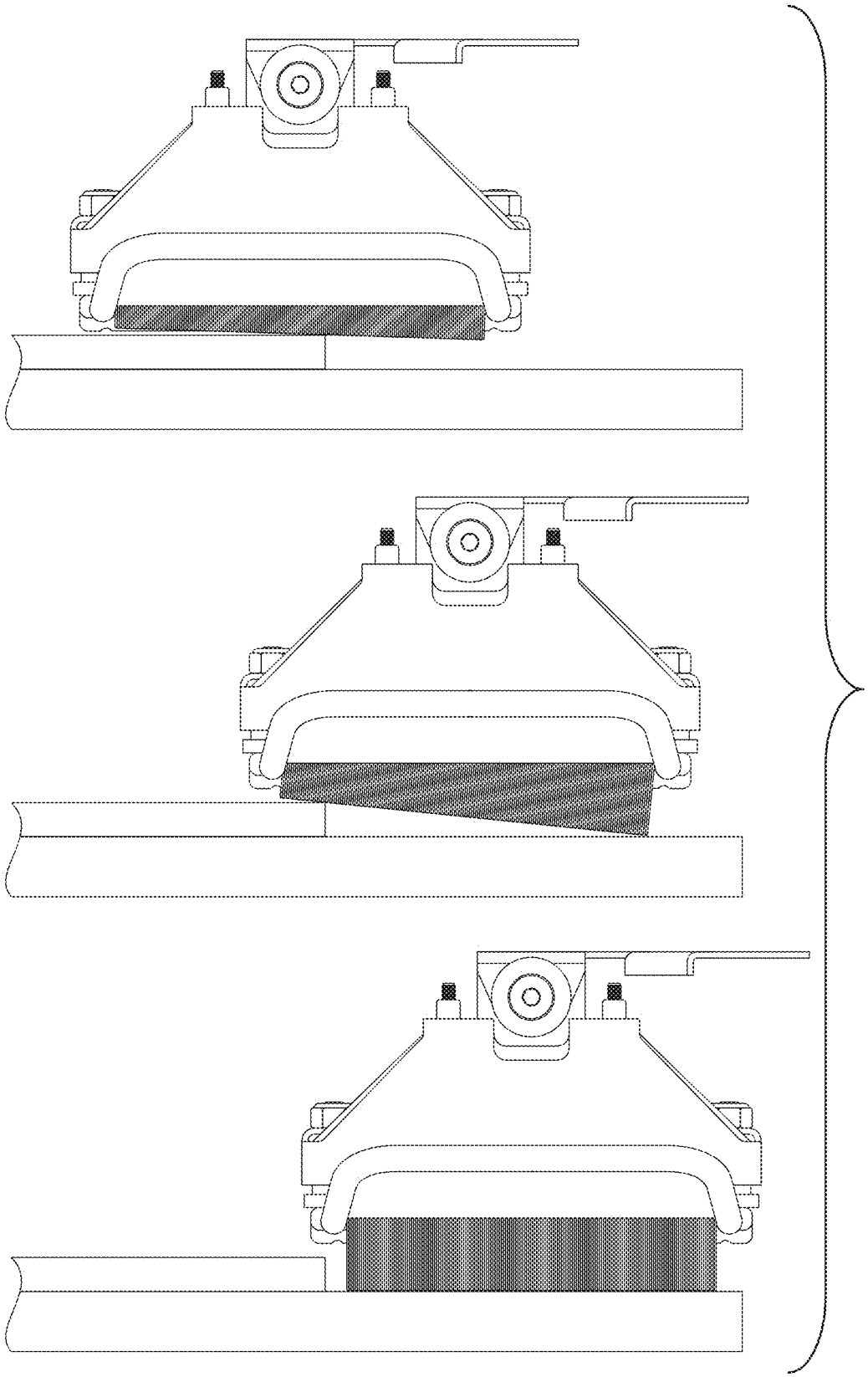
FIG. 10 is an illustration of one embodiment of an extraction head moving over a threshold.
Figure 11:
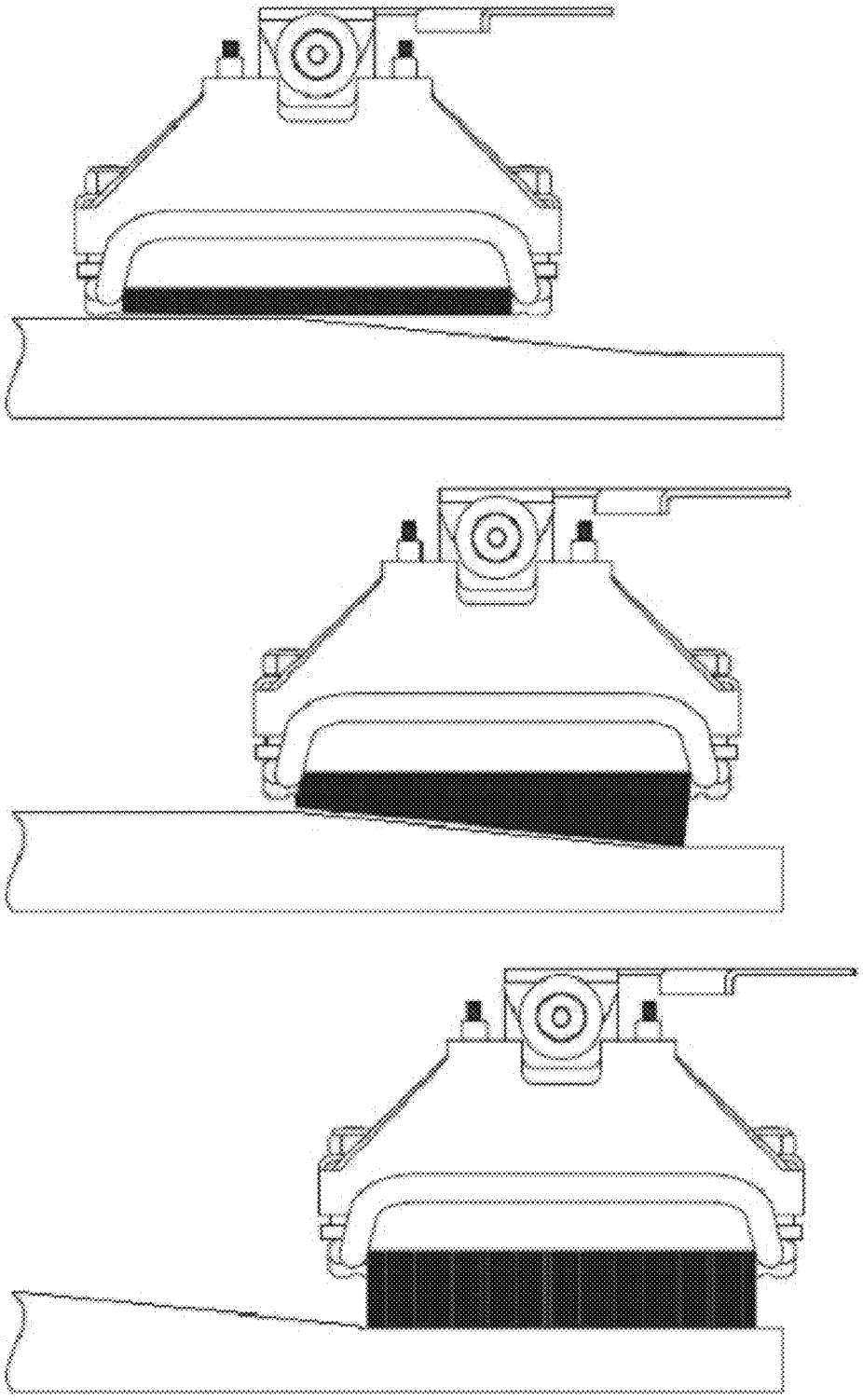
FIG. 11 is an illustration of one embodiment of an extraction head moving over an inclined surface.

The feature of independent vertical movement and rotational or tilting movement of the brushes 50 relative to the extraction head 14 provides several benefits as compared to brushes 50 that are stationary relative to the extraction head 14. The independent movement of the brush 50 on multiple axes helps to reduce premature wear on the brush 50 as the brush can move upwardly over rises or obstructions rather than forcing the rise or obstruction through the brush 50. Additionally, such movement helps to increase the cleaning consistency across the floor by helping to keep the bristles 52 in consistent contact with the floor, particularly around variable-height floor features (e.g., thresholds, HVAC registers, etc.). Further, such movements increase the cleaning efficacy as the brush tips rather than the brush stems contact the floor. Such movement also allows the base plate 42 of the extraction head 14 to remain near the floor and remove more debris and solution from the floor. These advantages are particularly true for brushes 50 on the cleaning devices that are rotary, moving the brushes 50 along an elliptical or circular path. The brushes 50 on the rotary cleaning device may contact irregular- or variable-height features on a floor at different angles depending on where the brush is along the elliptical or circular path. The brush movement allows the brush 50 to more effectively agitate the floor regardless of the angle at which the brush 50 is encountering the irregular- or variable-height feature as compared to brushes without this movement. Such movement of the extraction head over an irregular or variable-height feature is depicted in FIGS. 10-11. More particularly, FIG. 10 shows the movement of the extraction head over a threshold, with the brush adjusting in height. FIG. 11 shows the movement of the extraction head over an uneven or slanted floor, with the brush adjusting in height.

Figure 6:
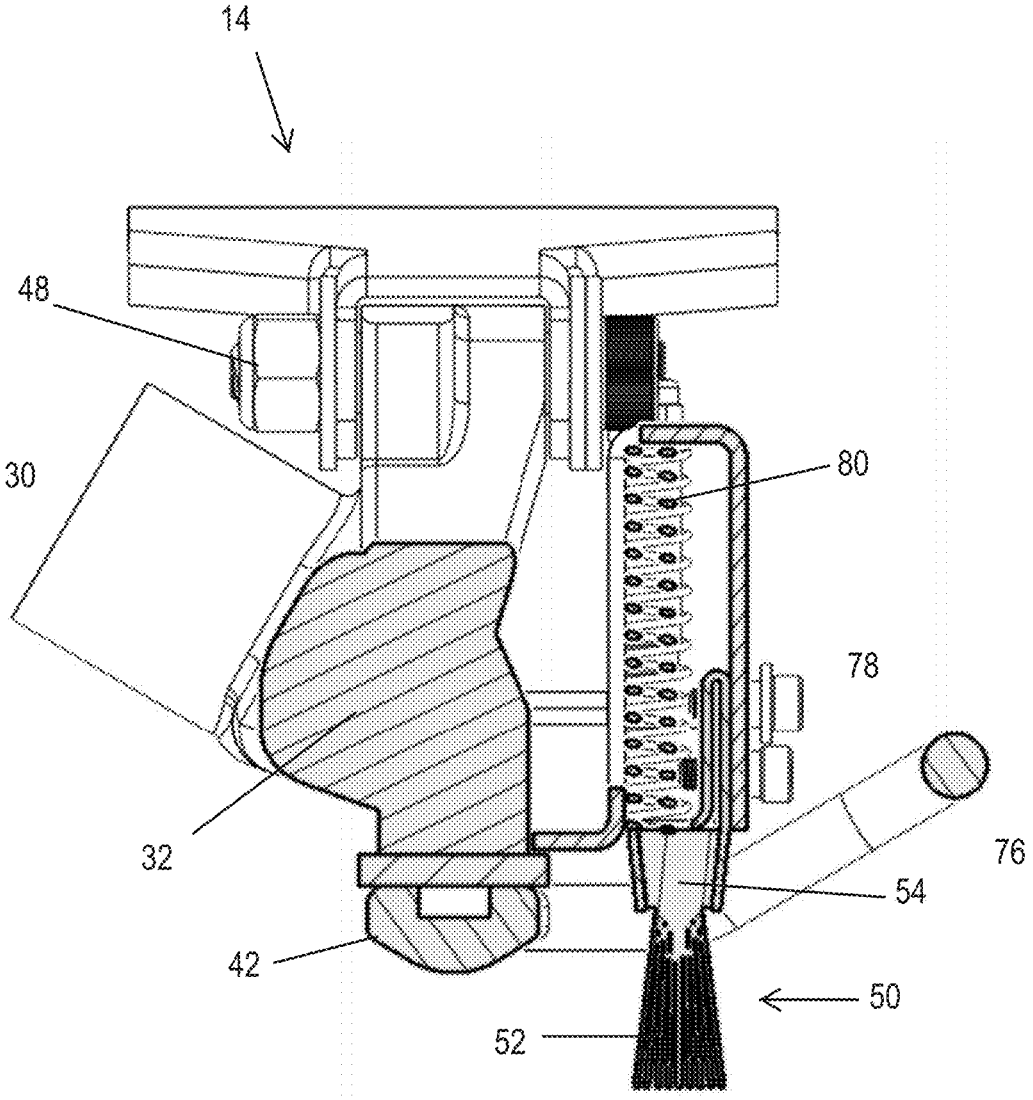
FIG. 6 is a cross-sectional view illustrating one embodiment of the extraction head.

As shown in FIG. 6, the brush 50 may be attached to the extraction head body 32 by a bracket 66. The bracket 66 may be integrally formed with the extraction head body 32 or be distinct components from one another. In some embodiments, the bracket 66 comprises a rear plate 68 adjacent to the extraction head body 32, a forward plate 70 opposite the rear plate 68, at least one side plate 72 connecting the rear and forward plates 68, 70, or at least one top plate 74 connecting the rear and forward plates 68, 70. In some embodiments, the rear plate 68, the forward plate 70, the side plate(s) 72, and the top plate(s) 74 define a partially enclosed brush socket 76. The bracket 66 may have an open bottom 78 for accessing the brush socket 76. The brush 50 may be securely received in the brush socket 76 via the open bottom 78.

At least one spring 80 is disposed between the brush bracket 66 and the brush 50. The at least one spring 80 biases the brush 50 away from the brush bracket 66. A spring guide 82 may be positioned in a central opening of the spring 80 and disposed on the brush ferrule 54 or the brush bracket 66. The spring guide 82 prevents the spring 80 from bending laterally as the brush 50 compresses the spring 80 against the brush bracket 66. In some embodiments, the spring guide 82 is a rod. The brush ferrule 54 and brush bracket 66 may each comprise indentations for receiving a top or a bottom of the spring 80, respectively. In further embodiments, the at least one spring 80 comprises a first spring 92 and a second spring 94, the springs 92, 94 positioned between the brush bracket 66 and the brush 50 and bias the brush 50 away from the brush bracket 66. Each of the springs 92, 94 may have the spring guide 82. Any suitable biasing element may be used in place of the at least one spring 80, such as a shock, a strut, or a similar biasing device.

The at least one spring 80 exerts both a downward force on the brush 50 and an upward force on the brush bracket 66. The downward force of the at least one spring 80 on the brush 50 increases the contact between the bristles 52 and the floor as the extraction head 14 moves over the cleaning path of the floor. The increased contact between the brush 50 and the floor agitates the floor to remove solution and debris. The upward force of the spring 80 may bias the brush bracket 66 and extraction head 14 away from the floor. An operator may select different springs 80 that exert varying amounts of force on the brush 50 and brush bracket 66 depending on the design of the cleaning device and the floor to be cleaned. For example, the upward force of the springs 80 on the bracket 66 may be less than or equal to the downward force, or weight, of the extraction head 14 to promote the cleaning efficiency of the extraction head 14.

Figure 2:
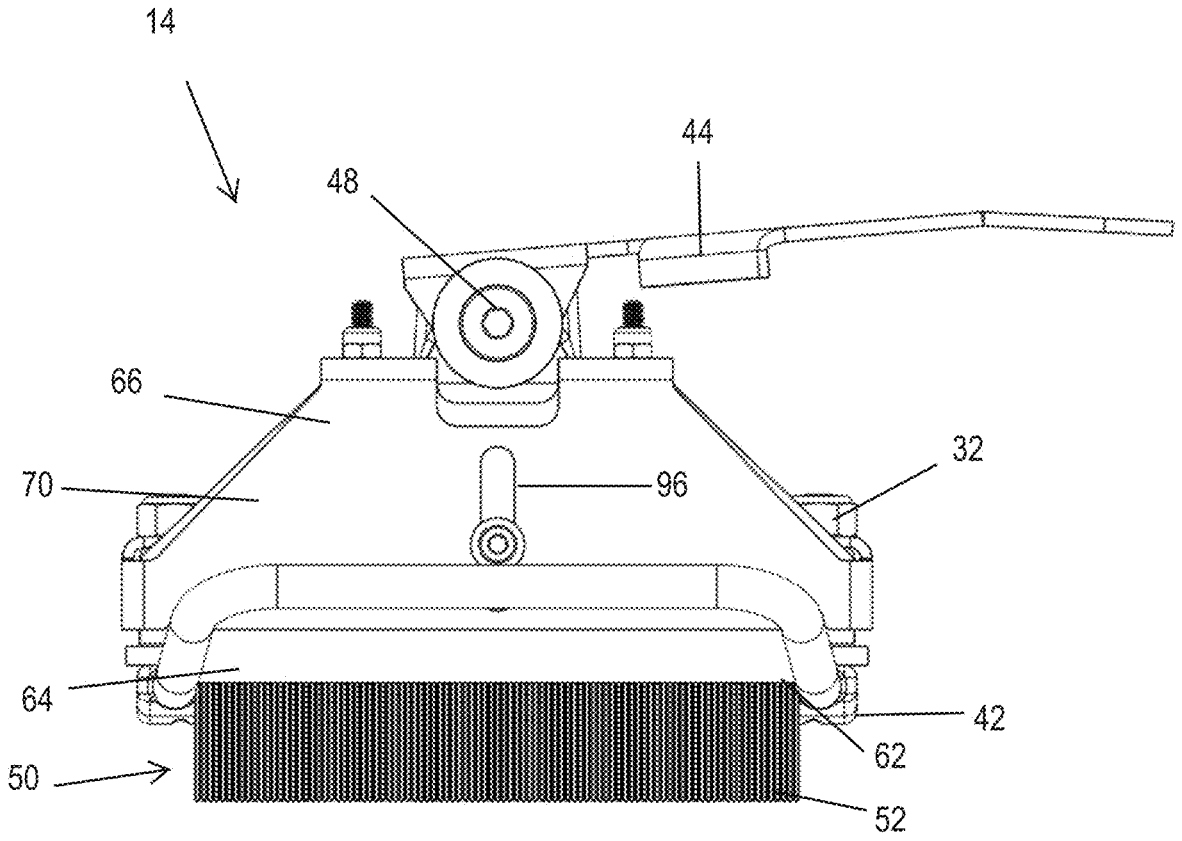
FIG. 2 is a front elevation view illustrating one embodiment of the extraction head.
Figure 3:
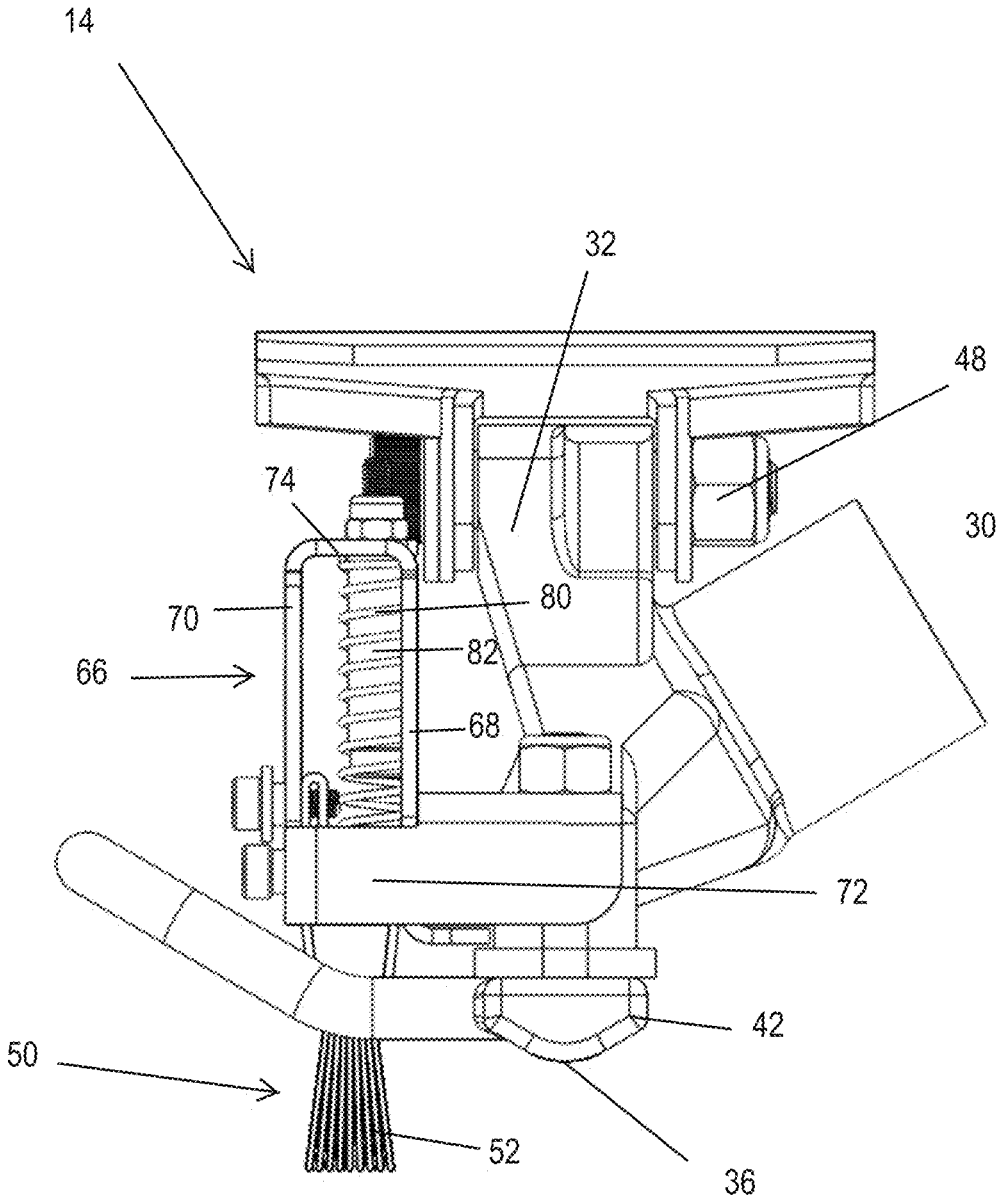
FIG. 3 is a right side elevation view illustrating one embodiment of the extraction head.
Figure 4:
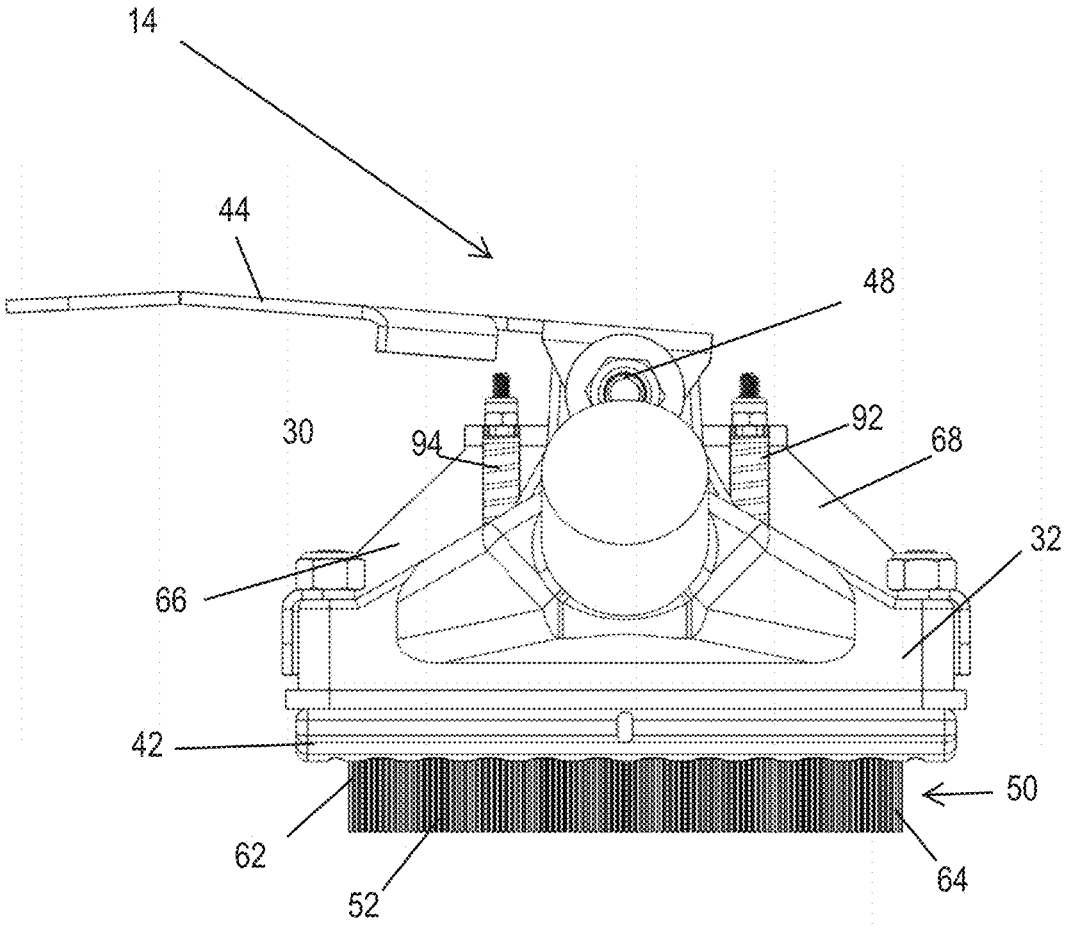
FIG. 4 is a rear elevation view illustrating one embodiment of the extraction head.
Figure 5:
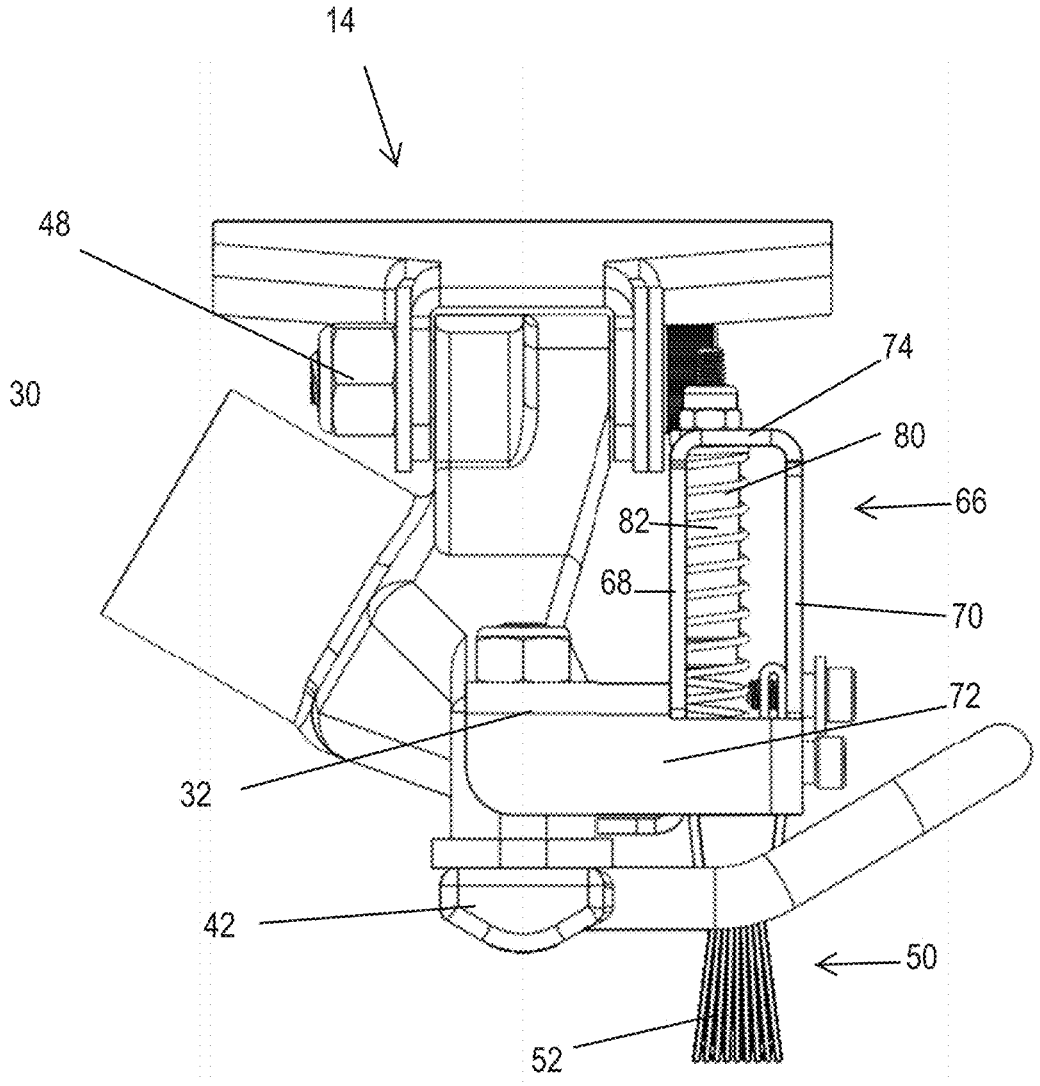
FIG. 5 is a left side elevation view illustrating one embodiment of the extraction head.

As shown in FIGS. 2 and 7-8, the extraction head 14 may comprise a guide track 96. The guide track 96 may be disposed on the brush bracket 66. For example, the guide track 96 may comprise a slot 98 in the rear or forward plates 68, 70 of the brush bracket 66. The guide track 96 may have a top end, a bottom end, and a track height defined by the distance from the top end to the bottom end. The guide track 96 may include a proximal edge closer to the center of the rotary vacuum head 10 and a distal edge opposite the proximal edge and farther from the center of the rotary vacuum head 10. A guide track width is defined by a distance between the proximal and distal edges. The guide track width and the guide track height may be in planes that are generally perpendicular to one another.

The brush 50 may have a first brush guide 110 disposed on or secured with the brush 50 and slidably engaged with the guide track 96. The first brush guide 110 may be positioned on the brush ferrule 54. A second brush guide 112 may be secured to the brush ferrule 54 and slidably engaged with the guide track 96. The brush guides 110, 112 may be vertically aligned such that they define an upper brush guide and a lower brush guide. The guide track 96 may restrict the brush 50 from moving toward or away from the center of the rotary vacuum head 14 when the brush guide(s) contact the proximal and distal edges, of the guide track 96. The guide track 96 may also restrict vertical movement of the brush 50 when the brush guide(s) contact a top or a bottom of the guide track 96. The upper brush guide may have a top edge, and the lower brush guide may have a bottom edge. A brush guide span6 may extend from the top edge of the upper brush guide to the bottom edge of the bottom brush guide. Together, both brush guides may restrict rotational movement, or the tilt, of the brush 50.

The brush vertical range and the brush tilt range may be varied depending on the type of floor to be cleaned and the variance in the height of the floor. The brush vertical range and brush tilt range may be modified by changing any combination of the guide track height, guide track width, and the brush guide span. For example, increasing the guide track height increases the brush vertical range while decreasing the guide track height decreases the brush vertical range. Increasing the brush guide span decreases the brush vertical range and the brush tilt range while decreasing the brush guide span increases the brush vertical range and brush tilt range. The brush vertical range is approximately equal to the difference between the guide track height and the brush guide span. Increasing the guide track width increases the brush tilt range while decreasing the guide track width decreases the brush tilt range. In some embodiments, the guide track width is shorter than the brush guide span to restrict the rotational movement of the brush.

As shown in FIGS. 1-2 and 7-8, the extraction head 14 may include a guide bar 128. The guide bar 128 extends away or forward from the base plate 42 relative to the direction of travel of the extraction head 14 to guide the extraction head 14 over raises or obstructions on the floor. For example, because the guide bar 128 extends forward in front of the base plate 42, the guide bar 128 will contact raised areas or features before the base plate 42 as the extraction head 14 moves over the variable-height floor. As depicted, the guide bar 128 may be configured with a leading bar 130 positioned above a plane defined by the base plate 42. As such, as the leading bar 130 encounters a raised feature or obstruction, the guide bar 128 will follow the raised feature or obstruction and consequently lift the base plate 42 over that raised feature or obstruction. In other words, the guide bar 128 protects the base plate 42 from impacts with the raised feature or obstruction and prevents the extraction head 14 from catching on raised features or obstructions on the variable-height floor. The brush 50 may be located in between the leading bar 130 and the extraction head body 32. In some embodiments, the brush 50 may contact the guide bar 128 when the brush 50 adjusts downward. Thus, the guide bar 128 may also restrict vertical movement of the brush 50 in addition to the brush guide(s) and the guide track 96.

Reference throughout this specification to features, advantages, or similar language does not imply that all of the features and advantages that may be realized with the present disclosure should be or are in any single embodiment of the invention. Rather, language referring to the features and advantages is understood to mean that a specific feature, advantage, or characteristic described in connection with an embodiment is included in at least one embodiment of the subject matter disclosed herein. Thus, discussion of the features and advantages, and similar language, throughout this specification may, but do not necessarily, refer to the same embodiment.

Furthermore, the described features, advantages, and characteristics of the disclosure may be combined in any suitable manner in one or more embodiments. One skilled in the relevant art will recognize that the subject matter of the present application may be practiced without one or more of the specific features or advantages of a particular embodiment. In other instances, additional features and advantages may be recognized in certain embodiments that may not be present in all embodiments of the disclosure.

The present disclosure may be embodied in other specific forms without departing from its spirit or essential characteristics. The above description of preferred embodiments should not be interpreted in a limiting manner since other variations, modifications and refinements are possible within the spirit and scope of the present disclosure. The scope of the invention(s) is defined in the appended claims and their equivalents.

What is claimed is:

1. An extraction head for a floor cleaning device for traveling along a cleaning path on a variable-height floor, the extraction head comprising:

an extraction head body including a floor-facing surface and an extraction aperture disposed in the floor-facing surface;

a vacuum outlet in fluid communication with the extraction aperture; and a brush positioned in front of the extraction head body along the cleaning path, the brush including a proximal end and a distal end opposite the proximal end, the proximal and distal ends configured to translocate upwardly and downwardly relative to each other as the extraction head moves along the cleaning path on the variable-height floor, a brush bracket adjustably securing the brush to the extraction head body, a guide track extending vertically on the brush bracket, a first brush guide slidably engaging the brush with the guide track, and a second brush guide slidably engaging the brush with the guide track and disposed below the first brush guide, wherein the first and second brush guides are vertically aligned, and wherein the brush is configured to translocate upwardly and downwardly as the extraction head moves along the cleaning path on the variable-height floor.

2. The extraction head of claim 1, wherein the extraction head body further comprises a base plate disposed on the floor-facing surface, and wherein the extraction aperture is disposed in the base plate.

3. The extraction head of claim 1, further comprising a first spring positioned between the brush bracket and the brush, wherein the first spring biases the brush away from the brush bracket.

4. The extraction head of claim 3, further comprising a first spring guide positioned in the first spring, wherein the first spring guide laterally secures the first spring as the brush compresses the first spring against the brush bracket.

5. The extraction head of claim 4, further comprising:

a second spring disposed between the brush bracket and the brush, the second spring including a central opening; and a second spring guide positioned in the second spring, wherein the second spring guide laterally secures the second spring as the brush compresses the second spring towards the brush bracket, wherein the second spring biases the brush away from the brush bracket, wherein the first spring is positioned toward the proximal end of the brush and the second spring is positioned toward the distal end of the brush.

6. The extraction head of claim 1, further comprising:

a proximal edge of the guide track;

a distal edge of the guide track opposite proximal edge;

a guide track width extending between the proximal edge and the distal edge;

a top edge of the first brush guide;

a bottom edge of the second brush guide; and a brush guide span extending from the top edge of the first brush guide to the bottom edge of the second brush guide, wherein the guide track width is less than the brush guide span.

7. The extraction head of claim 6, comprising:

a first spring positioned between the brush bracket and the brush, wherein the spring biases the brush away from the brush bracket; and a first spring guide positioned in a central opening in the first spring, wherein the first spring guide laterally secures the first spring as the brush compresses the first spring against the brush bracket.

8. The extraction head of claim 1, further comprising a guide bar extending from the extraction head opposite the vacuum outlet.

9. The extraction head of claim 8, wherein the guide bar contacts the brush and restricts downward movement of the brush when the brush adjusts downward.

10. A cleaning device, comprising:

a rotary vacuum head comprising a plurality of vacuum chambers disposed radially on the rotary vacuum head, each vacuum chamber including an inlet;

a plurality of extraction heads adjustably secured to the rotary vacuum head for traveling along a cleaning path on a variable-height floor, each extraction head comprising:

an extraction head body including a floor-facing surface and an extraction aperture disposed in the floor-facing surface;

a vacuum outlet in fluid communication with the extraction aperture; and a brush positioned in front of the extraction head body along the cleaning path, the brush including a proximal end and a distal end opposite the proximal end, the proximal and distal ends configured to translocate upwardly and downwardly relative to each other as the extraction head moves along the cleaning path on the variable-height floor;

a brush bracket adjustably securing the brush to the extraction head body;

a first spring positioned between the brush bracket and the brush;

a first spring guide positioned in the first spring;

a guide track extending vertically on the brush bracket;

a first brush guide slidably engaging the brush with the guide track; and a second brush guide slidably engaging the brush with the guide track, wherein the first and second brush guides are vertically aligned, the spring biases the brush away from the brush bracket, and the first spring guide laterally secures the first spring as the brush compresses the first spring against the brush bracket, wherein the brush is configured to translocate upwardly and downwardly as the extraction head moves along the cleaning path on the variable-height floor, wherein the plurality of extraction heads are adjustably secured to the rotary vacuum head, wherein each inlet is in fluid communication with the at least one vacuum outlet.

11. The cleaning device of claim 10, further comprising:

a proximal edge;

a guide track distal edge opposite guide track proximal edge;

a guide track width extending between the guide track proximal and distal edges;

a top edge of the first brush guide;

a bottom edge of the second brush guide; and a brush guide span extending from the first brush guide top edge to the second brush guide bottom edge, wherein the guide track width is less than the brush guide span.

* * * * *